US006231363B1

(12) United States Patent
Kosmala

(10) Patent No.: US 6,231,363 B1
(45) Date of Patent: May 15, 2001

(54) LOW PROFILE INTERCONNECTION

(75) Inventor: Michael Lawrence Kosmala, Mission Viejo, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/340,924

(22) Filed: Jun. 28, 1999

(51) Int. Cl.[7] ..... H01R 13/62
(52) U.S. Cl. ..... 439/260; 439/79
(58) Field of Search ..... 439/259–265, 439/629–637, 329, 326

(56) References Cited

U.S. PATENT DOCUMENTS 4,936,790 * 6/1990 De La Cruz ..... 439/260
5,397,857 3/1995 Farquhar et al. ..... 174/52.1
5,409,385 4/1995 Tan et al. ..... 439/76
5,470,246 * 11/1995 Mosquera ..... 439/260
5,475,919 12/1995 Wu et al. ..... 29/841
5,807,126 9/1998 Bethurum ..... 439/259

* cited by examiner

*Primary Examiner*—Hien Vu
(74) *Attorney, Agent, or Firm*—Roger C. Turner

(57) ABSTRACT

An electronic device such as an IC card (10), is provided with a plug-receiving receptacle connector (18) at its rear end which is of simple and compact design so it takes up a minimum of space and allows direct connection between the plug contacts (34) and circuitry (80) on the circuit board (12) of the electronic device. An IC card has a top cover (50) with a portion (56) of molded polymer material that forms a cavity (20) between its rear end and the rear of the circuit board upper face into which the plug can be inserted. The circuit board has traces (80) on its upper face and the molded portion of the cover forms cam walls for depressing plug contacts against the traces. The lower cover has a polymer cover portion (62) that supports the rear end of the circuit board and that forms a lead-in (86) for guiding a plug into the cavity. The plug has contacts whose free forward end portions each includes a horizontal rear section (106) and an inclined front section (108).

4 Claims, 3 Drawing Sheets

LOW PROFILE INTERCONNECTION

BACKGROUND OF THE INVENTION

IC cards are commonly constructed in accordance with standards of PCMCIA (Personal Computer Memory Card International Association) which specifies a maximum card thickness of 5 mm for the most popular type of card, which is the Type II card. IC cards generally have a circuit board with a connector at the front end and with primarily sheet metal top and bottom covers. The standard front connector has 68 pins arranged in two rows, along a height of about 3.2 mm. One more recent advancement in IC cards is to provide a rear connector which enables the transmittal of data through the card into the electronic device which receives the card. Rear connector designs such as that shown in U.S. Pat. No. 5,554,045 occupy almost the entire 5 mm height of the rear of the card, with the circuit board being cut out to leave room for the rear connector. Although the front connector has 68 contacts, it is generally sufficient to provide less than half that number of contacts at the rear connector. It would be desirable if a rear connector for an IC device was available that occupied a minimum of space and was of especially simple design. Features of such connector would be desirable for other applications where a minimum of space is available, such as in portable telephones.

Recent developments in the construction of covers for IC cards include the provision of top and bottom covers with plastic peripheries that can be connected by ultrasonic welding. Ultrasonic welding of plastic uses moderate cost equipment, as compared to the more expensive and less available spot welding equipment for solely sheet metal covers. The covers include sheet metal with the plastic periphery regions molded to the edges of the sheet metal. A simple rear connector which occupied a minimum of space and that could be readily formed in an IC card or other device with molded polymer peripheral regions would be of value.

SUMMARY OF THE INVENTION

In accordance with one embodiment of the present invention, a connector is provided, which is especially useful at the rear of an IC card, which is of simple and compact design. The IC card or other device has a circuit board and top and bottom covers with molded polymer portions lying above and below a rear end portion of the circuit board. The molded polymer portion of the upper cover is constructed to form a rearwardly-opening cavity between itself and the upper face of the circuit board. The upper face of the circuit board carries electrically conductive traces and the top cover is molded with cam walls lying above the traces to deflect contacts of a mating plug against the traces. In an IC card, this construction results in direct connection of the plug contacts to the circuit board traces, without requiring a separate rear connector with pins to make connections, thereby providing higher reliability. Also, the bottom of the circuit board and an area below the circuit board is now available for holding circuitry and/or circuit components. The side and top walls of the cavity of the connector, are integral with the molded polymer portion of the upper cover, to eliminate the cost and need for separate mounting of a separate rear connector element.

The plug which can be inserted into the cavity is constructed so it has a very small height. The plug contacts have free forward portions with rear sections that extend horizontally and front sections that extend at a downward-forward incline. The contact front sections can directly engage the cam walls formed on the upper cover.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
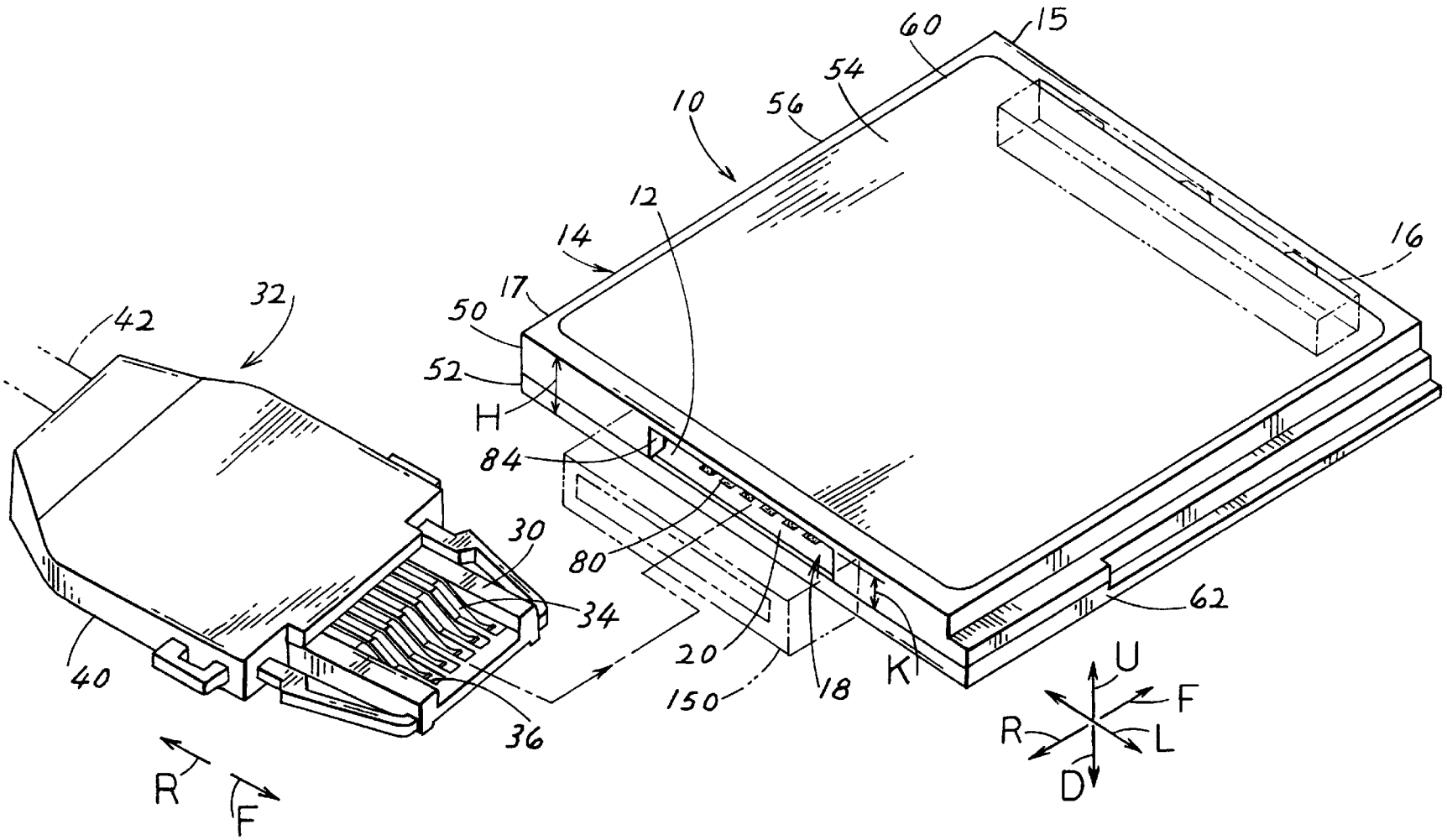
FIG. 1 is an exploded isometric view showing an IC card and a plug of the present invention, separated from each other, and also showing, in phantom lines, another plug construction.

FIG. 1 illustrates an IC card 10 which includes a circuit board 12, a housing 14 with front and rear ends that surrounds most of the circuit board, a front connector 16 at the front of the card, and a rear connector 18 at the rear of the card. The particular card has a height H in up and down directions U, D of 5 mm and a width in a lateral direction L of 54 mm, to fit into a slot of an electronic device that is designed to receive a Type II card. The front connector 16 has 68 contacts arranged in a standard pattern for this type of card, to mate with a connector (not shown) at the front of a slot in an electronic device that can receive the card 10. The length of the card in front and rear directions F, R is less than that of the most common type of card. The rear connector 18 includes a cavity 20 that opens in a rearward direction R, to receive the forward end 30 of a plug 32. The plug has a row of contacts 34 that lie in slots 36 of the plug front end. The plug rear end 40 is connected to a cable 42 that connects to other devices such as a modem, facsimile machine, another computer, etc.

The housing 14 of the IC card 10 includes top and bottom covers 50, 52. Each cover such as the top cover, includes a sheet metal part 54 that lies over substantially the entire circuit board (over at least 75% of it) and a molded polymer edge portion 56 that is molded to the edge 60 of the sheet metal part 54. It is noted that the sheet metal part of the lower cover 52 lies "over" substantially the entire circuit board in that this will occur when the card is turned upside down from the position shown in the drawings.

For the bottom cover 52 the molded polymer edge portion is shown at 62. The provision of the edge portions 56, 62 enables the top and bottom covers 50, 52 to be easily joined by ultrasonic welding of their polymer edge portions. Earlier, the top and bottom covers were made entirely of sheet metal, and had to be welded together, which presented a difficulty because of the high cost of welding equipment.

Figure 2:
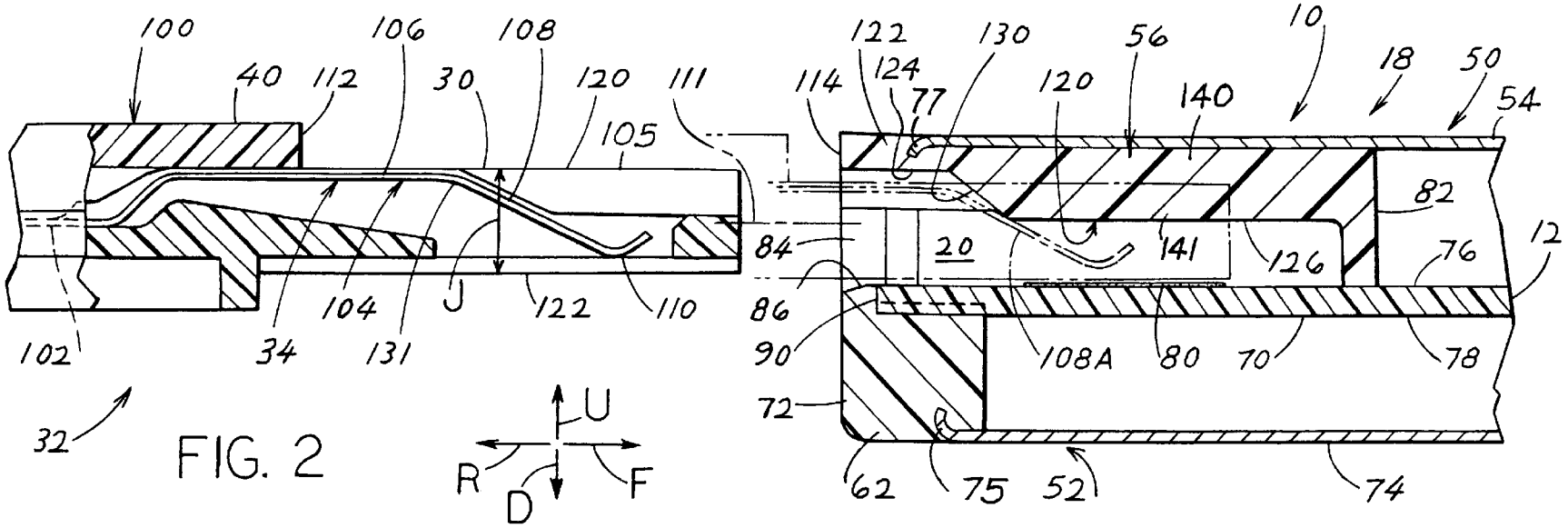
FIG. 2 is an exploded sectional side view of the IC card and plug of FIG. 1, prior to their connection, and showing in phantom lines, the plug contact when it first contacts the cam wall of the IC card connector.

FIG. 2 shows the construction of the rear connector 18 and of a portion of the plug 32. The circuit board of the rear connector has a rear end 70 that is supported by a support part 72 of the molded polymer part 62 of the bottom cover 52. It can be seen that the bottom cover includes a sheet metal part 74 whose periphery 75 is molded to the polymer part 62 of the lower cover. Similary, the top cover sheet metal part 54 has a periphery 77 that is molded to the polymer edge portion 56. The circuit board has upper and lower faces 76, 78, with a row of traces 80 on its upper face, at the rear end 70 of the circuit board. The molded polymer edge portion 56 of the top cover 50 has a rear end portion 57 that forms the top wall of the cavity 20, and also forms a front wall 82 and side walls 84 of the cavity, with the upper face of the circuit board forming the bottom wall of the cavity. The support part 72 of the molded polymer part 62 of the lower cover, forms a lead-in 86 that lies directly behind the extreme rear edge 90 of the circuit board.

The plug includes a frame 100 and plug contacts 34. The plug contacts have rear portions 102 that are fixed to the frame and have free front portions 104 lie at a frame front end 105 and that that are free to be deflected downwardly. Each plug contact free forward potion includes a rear section 106 that extends horizontally, and a front section 108 that extends at a forward and downward incline and that has a convex lower surface 110 at its front end.

When the plug is inserted along an insertion axis 111 into the cavity 20 to the position shown in phantom lines in FIG. 2, the inclined front section at 108A first encounters a cam wall 120 formed by the connector upper wall 122. The cam wall has a construction similar to that shown in U.S. Pat. No. 5,807,126 with horizontal rear and forward ends 124, 126, and with an inclined middle part 130. The inclined front section at 108A of the plug contact, is inclined at a slightly smaller angle from the horizontal than the wall part 130. Further forward movement of the plug from the position shown in FIG. 2, results in the front section being deflected to the position shown at 108B in FIG. 3. The contact rear section 106 is also deflected, to the position 106B. Such deflection results in the convex lower surface at 110 engaging a trace 80 of the circuit board. The trace 80 may be connected directly to a contact of the front connector, or to components on the circuit board. Forward insertion of the plug is limited by engagement of stops 112, 114 of the plug and receptacle connectors.

Figure 3:
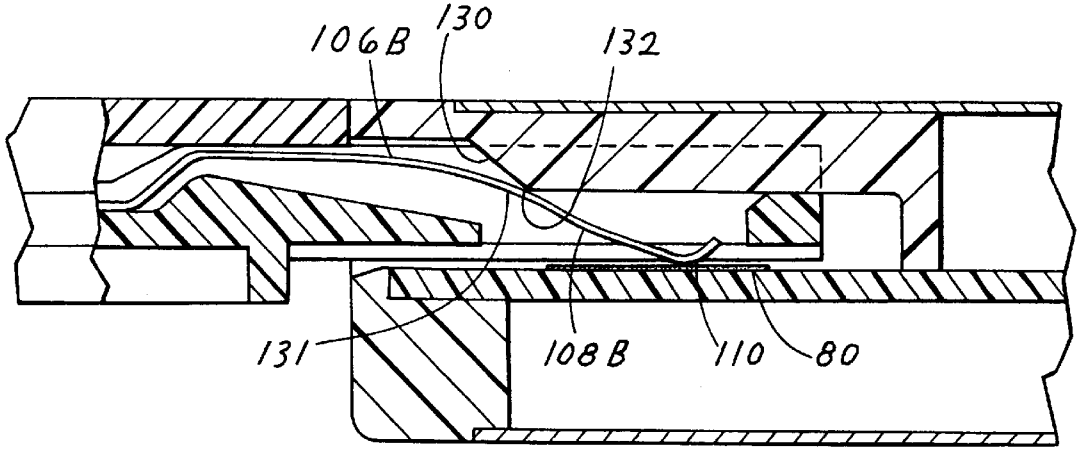
FIG. 3 is a view similar to that of FIG. 2, but with the plug in its fully installed position in the IC card.

FIG. 2 shows that the rear section 106 of the plug contact 102 extends parallel to the insertion axis 111 and to the frame front top and bottom surfaces 120, 122. The contact rear section 106 preferably lies even with or slightly below (e.g. 0.1 mm below) the frame surface 120. By using a horizontal rear section 106 of the contact, applicant is able to fit the contact, which has the inclined front section 108, into a plug of very small height J along its front end 30. For an IC card 10 of a height of 5 mm, the maximum height of the cavity 20 is a fraction of this height, such as a height of about 2 mm. It is difficult to construct a receptacle-received end of a plug with such a small height. Applicant's use of a horizontal rear section 106 of the free front portion 104 of the contact, helps to achieve this low height. As a result, applicant uses the inclined section 108 to engage the inclined middle part 130 of the cam wall to downwardly deflect the plug contact against the circuit board trace. FIG. 3 shows that the intersection 131 of the contact front and rear sections preferably lies rearward of the forward or lower end 132 of the inclined middle part 130 of the cam wall, in the fully installed position of the plug.

Figure 4:
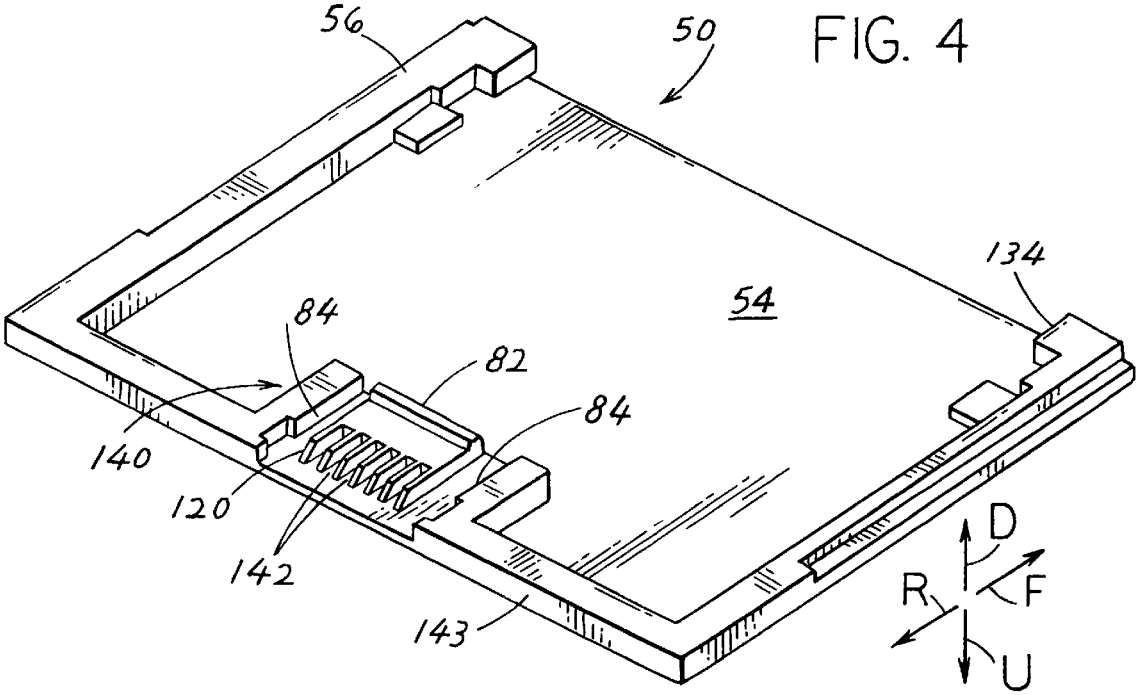
FIG. 4 is an upside-down isometric view of the top cover of the IC card on FIG. 1.
Figure 5:
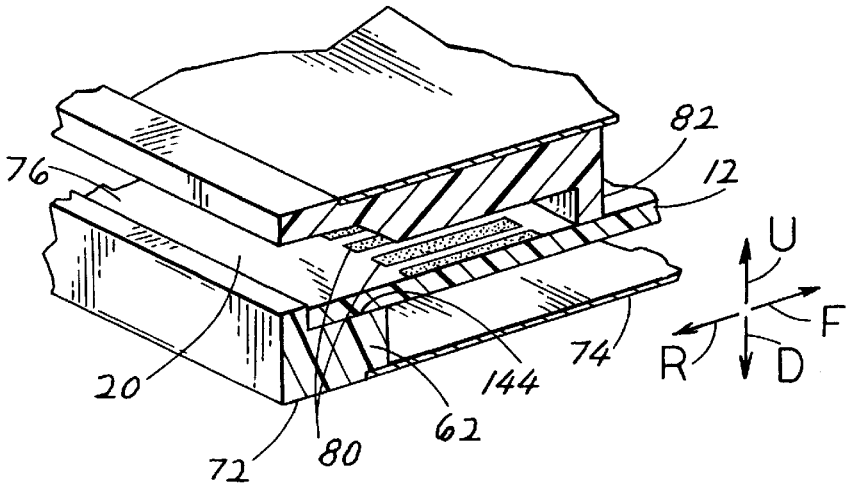
FIG. 5 is a sectional isometric view of a portion of the connector of the IC card of FIG. 1.

FIG. 4 is an upside-down view showing the construction of the top cover 50. It can be seen that the sheet metal part 54 occupies most of the area of the cover while the molded polymer edge portion 56 occupies most of the periphery of the sheet metal part. A gap is left at 134 to accommodate the front connector. It can be seen that a rear region 140 at the rear of the molded edge portion forms the side walls 84 and forward wall 82 of the cavity, and also forms the cavity upper wall 141 that includes cam walls 120 and slots 142 that lie between adjacent cam walls. It is possible to have cam walls or cam wall areas not separated by slots. It can be seen from FIG. 4 that the region 140 that forms the side and top walls of the plug-receiving cavity, is formed integral with the rest 143 of the edge portion 56 of the top cover. This avoids the need to form a separate rear connector housing or frame, and mount it in the card. The side walls 84 of the cavity could be formed by upward projection the lower cover peripheral portion that project up through slots in the circuit board. As discussed above, the provision of conductive traces 80 (FIG. 5) on the upper face of the circuit board 12 results in direct connection of the plug contact with circuitry (including the traces) on the circuit board 12. A disadvantage of this construction is that the height of the cavity 20 is limited, because the bottom of the cavity is at the height of the circuit board upper face 76, and the circuit board is supported on the support 72 formed by the polymer molded part 62 of the lower cover. The support surface 144 of the molded polymer edge part 62 can be lowered to be slightly above the upper surface of the lower cover sheet metal part 74, to increase the height of the cavity 20, although the height will still be limited by the circuit board and molded part 62. However, the achievement of a low cost and simple connector housing, with direct engagement of plug contacts with circuit board traces, results in a great advantage.

It should be noted that in some IC cards, where there is no room to provide a rear connector, it is possible to provide a rearwardly-projecting rear connector. This is shown in phantom line at 150 in FIG. 1. The projecting connector 150 is formed by portions of the molded polymer edge portions of the top and bottom covers, with a circuit board having a rearwardly-projecting part.

Although applicant has shown the connector in an IC card, the same connector construction can be used in other applications where very little space is required and a limited number of contacts are sufficient. For example, in a portable telephone, applicant's connector can be constructed by providing top and bottom covers that surround a circuit board, where at least the upper cover includes a molded polymer that is molded to form the side and top walls of a cavity and the cam walls of the connector. The cavity is then still formed between the molded top wall and the circuit board which has traces on it.

While terms such as "top", "bottom", etc. have been used to describe the invention as illustrated, it should be noted that the IC card or other device that includes the connector, can be used in any orientation with respect to the Earth.

Thus, the invention provides a receptacle connector for an IC card or other device that includes a circuit board and a top cover with a molded polymer portion. The molded polymer portion is molded to form a cavity between itself and the upper face of the circuit board. The circuit board upper face has traces and the top cover polymer portion forms cam walls for deflecting plug contacts against the traces, the polymer preferably also forming side and front walls of the cavity. A bottom cover preferably has a molded polymer portion that supports the rear of the circuit board and that forms a lead-in that lies directly rearward of the circuit board rear edge. The invention also provides a plug of low profile, with contacts having a free front end portion comprising a horizontal rear section and an inclined front section. The contact inclined front section engages a deflecting part of the cam wall.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An IC card which comprises a circuit board and a housing with top and bottom covers that extend over most of the circuit board, where said IC card has a card rear end a rear connector for receiving a plug having plug contacts, wherein:

said circuit board has upper and lower faces and has a board rear end with said board rear end having a plurality of electrically conductive traces on said board upper face;

each of said covers includes a sheet metal part that extends over most of the cover with each of said sheet metal parts having a periphery, each cover including a molded polymer edge portion molded around more than half of the periphery of the sheet metal part of the cover so the covers can be joined by joining the polymer edge portions of the bottom and top covers;

the molded polymer edge portion of said top cover has an integrally molded rear region that forms part of the walls of a rearwardly-opening cavity lying above said board upper face at said board rear end, said rear region of said top cover forming a cavity upper wall that is vertically spaced from said circuit board to receive the plug with plug contacts and with said cavity upper wall forming a plurality of cam walls extending at forward and downward inclines and lying above said traces to press said plug contacts against said traces;

said rear end of said circuit board has an edge:

at said rear end of said housing, said polymer molded part of said bottom cover forms a support part that extends below and rearward of said rear edge, of said circuit board with said support part supporting said rear end of said circuit board.

2. The IC card described in claim 1 including said plug, and wherein:

said plug has a frame with a front end that fits into said cavity when said plug is slid in a predetermined forward direction along an insertion axis, said frame front end having top and bottom surfaces and a plurality of vertical through slots that each holds part of one of said plug contacts;

each of said plug contacts has a rear portion fixed on said frame and a free front portion, each free front portion including a rear section that extends forwardly from said rear portion, said rear section extending substantially parallel to said top surface of said frame front end and lying substantially at the height of said top surface of said frame front end, each plug contact free front portion including a front section that extends at a forward-downward incline from a front end of said front section and that has a front end that is bent to have a convex lower surface for engaging one of said circuit board traces.

3. The combination of an IC card and a plug, where the plug has a plurality of contacts, each contact having a rear section which extends largely horizontally and a front end that extends at a downward and forward incline, said IC card comprising:

a circuit board having front and rear ends and upper and lower board faces, with said rear end having a plurality of conductive traces on said upper board face;

a housing having front and rear ends and opposite sides, said housing having top and bottom covers that each includes a sheet metal part that extends over most of said circuit board, each sheet metal part having a periphery, each cover including a polymer molded part that is molded of a polymer material to the periphery of the corresponding sheet metal part, and with the polymer molded part of each cover extending along at least portions of said opposite sides and said rear end of said housing and with said molded parts of said top and bottom covers bonded together;

at said rear end of said housing, said molded part of said top cover is constructed to form a cavity between said top cover and said circuit board upper face at said traces, said cavity having an open rear end and being open in a rearward direction;

said molded part of said top cover at said rear end of said housing, forming a plurality of cam wall surfaces that have forwardly and downwardly inclined walls to depress contacts of said plug against said traces on said circuit board.

4. An electronic device comprising:

a circuit board that has front and rear ends and upper and lower faces, said rear end having a plurality of electrically conductive traces thereon;

a housing which includes top and bottom covers that lie respectively above and below said circuit board, said covers having molded polymer peripheral portions of molded plastic that extend around a majority of each cover and which are joined together;

said peripheral portion of said top cover having a rear region which forms at least the top wall of a cavity in conjunction with said circuit board rear end, said housing forming largely vertically-extending side walls of said cavity, said circuit board rear end forming a largely horizontally-extending bottom wall of said cavity, said cavity opening in a rearward direction, and with said top wall of said cavity being integral with said molded polymer peripheral portion of said top cover which is joined to said peripheral portion of said bottom cover;

the top wall of said cavity forming a plurality of cam walls that each has a downward-forward inclined part; and including a plug with a plug frame having a font end constructed to be inserted along an insertion axis into said cavity, and with said plug having a plurality of plug contacts;

said plug contacts have free front portions with rear sections that extend parallel to said insertion axis and front sections that extend at forward-downward inclines when said rear sections are horizontal;

said plug frame and said housing each having stops, with said stops being positioned to abut each other to limit forward insertion of said plug into said cavity, and when said stops abut each other said contact front section engages the front ends of said inclined parts of said cam walls.

* * * * *